United States Patent [19]

Berg

[11] 4,192,646

[45] Mar. 11, 1980

[54] HEAT CONSERVATION IN WORKPIECES

[75] Inventor: Charles A. Berg, Buckfield, Me.

[73] Assignee: Pyreflex Corporation, Buckfield, Me.

[21] Appl. No.: 888,211

[22] Filed: Mar. 20, 1978

[51] Int. Cl.[2] ..... F27D 3/00; F27D 5/00

[52] U.S. Cl. ..... 432/239; 432/245; 432/253

[58] Field of Search ..... 432/239, 253, 245

[56] References Cited

U.S. PATENT DOCUMENTS

| | | | |
|---|---|---|---|
| 1,414,789 | 5/1922 | Pyle | 432/239 |
| 1,887,904 | 11/1932 | Johnson | 432/239 |
| 2,003,970 | 6/1935 | Machlet | 432/245 X |
| 3,626,154 | 12/1971 | Reed | 126/200 X |
| 3,747,908 | 7/1973 | Anderson | 432/209 |
| 3,771,775 | 11/1973 | Reinbold et al. | 432/245 |

*Primary Examiner*—John J. Camby

*Attorney, Agent, or Firm*—Kenway & Jenney

[57] ABSTRACT

An apparatus for transporting a workpiece at high temperature is provided with enclosure means substantially surrounding a workpiece supported, or gripped by, the apparatus. The enclosure includes an interior surface positioned to be exposed to the workpiece and formed from a material that is highly reflective of infrared radiation. Separate segments of the enclosure are movable relative to each other (e.g., hingedly connected to each other) to permit entry and removal of a workpiece. Provision is also made for introducing an inert atmosphere into the enclosure.

8 Claims, 5 Drawing Figures

HEAT CONSERVATION IN WORKPIECES

BACKGROUND OF THE INVENTION

This invention relates to a device to retain heat that is normally lost from workpieces (i.e., forging billets) that have been preheated to an elevated temperature. For example, billets must be preheated to high temperatures for forging, or for other types of severe mechanical forming processes, so that they may be readily deformed. It is common practice in forging operations to preheat billets in "batch process" furnaces and to remove a billet to transport it to the forging die as operations at the die permit. Because the billet loses heat to its environment during transport to the forging die, it has been necessary to preheat to a higher temperature than is actually necessary for forging in order that the billet be at a suitable temperature at the time it reaches the die and throughout the forging operation.

In addition, such heat loss shortens the time available for the actual forging operation. For example, titanium generally cannot be forged once the temperature has dropped below 1400° F., and steel generally cannot be forged below 1900° F. Titanium is typically preheated to approximately 1800° F. and steels to 2350° F. to 2450° F. to compensate for heat loss during transportation. During the typical one to two minute period required to transport a titanium billet to the die, the temperature typically will have dropped to about 1650° F. The time for the temperature to drop to 1400° F. will, of course, be much shorter than if the billet had arrived at the die at 1800° F. This shortening of the time during which forging operations can be undertaken on the billet can be quite expensive in terms of reduced production capacity. Thus, if forging cannot be completed in the short time available (typically about five minutes), the billet must be reheated and forged again. Not only does this tie up equipment for a longer period of time before the desired product is achieved, but problems of quality control are also introduced.

SUMMARY OF THE INVENTION

In view of the above discussion, it is a principal object of the present invention to provide an arrangement by which the problems discussed above can be substantially avoided. More specifically, it is an object of the invention to provide an arrangement which gives the option of either preheating workpieces to a lower temperature than would customarily be necessary or facilitating delivery of workpieces at a work station (e.g., a forging die) at a higher temperature for a given level of preheating in order to increase the length of time before the workpiece cools to an unsuitably low temperature.

Briefly, the invention resides in improvements in apparatus employed for transporting a workpiece that is at a temperature substantially above the ambient. In particular, according to the present invention, such apparatus is provided with enclosure means disposed to substantially surround both the support means that support the actual workpiece and the workpiece thus supported. The enclosure means include an interior surface positioned to be exposed to the workpiece and formed from a material that is highly reflective of infrared radiation. The enclosure means is provided as at least two segments, one of which is movable relative to the other.

BRIEF DESCRIPTION OF THE DRAWINGS

Other objects, features, and advantages of the invention will appear from the following description of a particular preferred embodiment, taken together with the accompanying drawings in which the dimensions of various elements have been exaggerated for clarity of explanation of the invention.

In the drawings.

DETAILED DESCRIPTION OF A PARTICULAR PREFERRED EMBODIMENT

General

Figure 1:
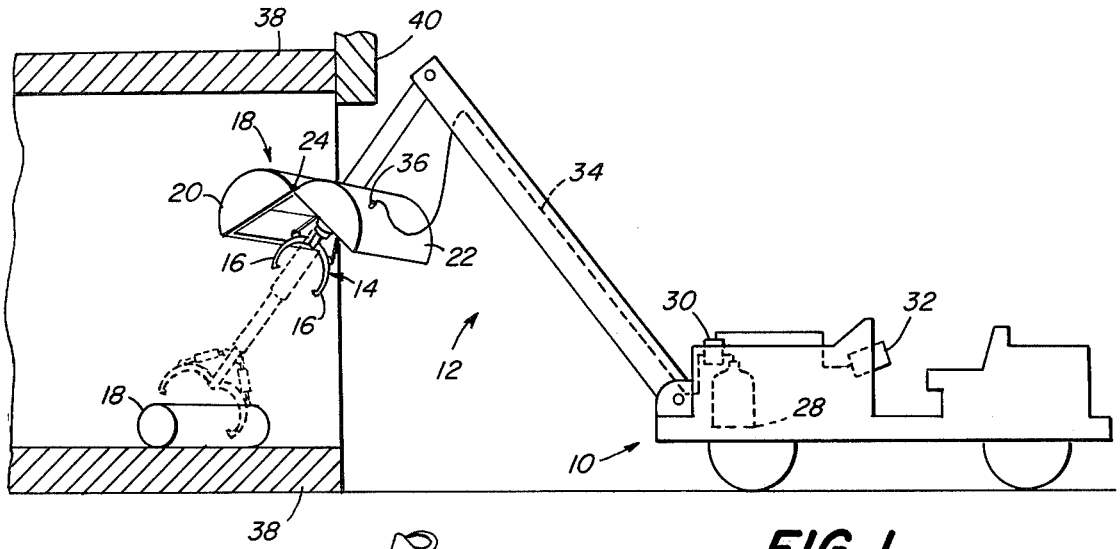
FIG. 1 is a partly schematic perspective view of apparatus incorporating features of the present invention.

The present invention is based upon recognition of a problem, analysis of the problem to determine key contributing factors, and devising an arrangement to effect a solution.

In particular, it has been recognized that heat loss from heated workpieces during transport between work stations (or during a holding operation while a given work station is being prepared for further work on the workpiece) is a source of multiple problems. As is discussed briefly above, the rapid cooling of very hot workpieces to the much cooler ambient requires substantial overheating of workpieces, with attendant energy waste, in order that the workpieces be at the appropriate temperature when the next operation on the workpiece can begin (e.g., after transport to the next work station; for example, a forging die). The heat loss can also shorten the time period within which further operations must be accomplished and can cause other problems. For example, in the case of a forging billet, rapid cooling in the brief period (e.g., one to two minutes) required for transporting a large forging billet from a preheating furnace to a forging die can cause the surface of the billet (e.g., the outer inch or so) to be substantially cooler than the remainder of the billet. The resulting strong temperature gradients will be accompanied by even stronger gradients of yield stress, causing the billet to be harder at its surface than throughout its core. This can lead to the production of undesirable distributions of deformation in a forging process that could lead to early failure of the forged part.

Calculations indicate that, of the three mechanisms of potential cooling of the heated workpiece (conduction, convection, and radiation), by far the predominant mechanism of cooling of the workpiece is radiational cooling.

That conductive heat losses are negligible can be confirmed by direct observation. For example, a forging billet or blank being moved in the grips of a self-propelled gripping-and-tractor device contacts the grip over only a very small area (since the grip is designed to "bite" into the blank), thus rendering the conductive heat path very small in cross section. The logical conclusion of low conductive heat loss is confirmed by the further observation that, despite the fact that the mass of the grips themselves is typically small compared with that of the billet, the grips are not observed to be the recipient of a large flow of heat from the billet.

The transfer of heat from the blank to the surrounding air occurs to passive (as opposed to forced) convection. For passive convection in the atmosphere, the film coefficient (h) is approximately 1 Btu/hr-ft$^2$ °F. Assuming that the surrounding air temperature is approximately 77° F., the rate of heat loss ($Q_c$) from the blank by convection will be, $$Q_c = hA(\Delta T),$$

where A is the area of the blank and ΔT is the difference between the surface temperature of the blank and the temperature of the surrounding air. Given the data cited above, one finds convective heat losses from the blank to be $$Q_c/A = 2273 \text{ Btu/ft}^2\text{·hr}.$$

For highly heated metal workpieces, the radiant heat losses are substantially greater. When metals are heated to high temperature their emissivity approaches unity. Thus, for steel at about 2350° F., for stainless steel at about 2450° F., and for titanium at about 1800° F., the emissivity ($\epsilon_1$) of the metal is approximately 0.90, or perhaps even greater.

The blank loses heat by radiation to an environment at approximately 77° F. One assumes that the environment has an emissivity ($\epsilon_2$) near unity. The net radiant heat transfer from each unit of area of the blank to the environment is given, approximately, by $$\frac{\sigma(T^4_{Blank} - T^4_{Environment})}{1/\epsilon_1 + 1/\epsilon_2 - 1}$$

where denotes the Stephan-Boltzman constant for radiation ($\sigma = 0.1713 \times 10^{-8}$ Btu/hr·ft$^2$ (°F.)$^4$), $\epsilon$ denotes the emissivity and T denotes the absolute temperature. Given the data cited above, one finds that the rate of radiant heat loss ($Q_R$) from the blank is $$(Q_R) = 100{,}386 \text{ Btu/ft}^2\text{·hr}.$$

Thus, of the total rate of heat loss from the hot metal blank, approximately 98 percent is due to radiation.

The analysis thus leads one to focus upon eliminating radiative heat loss as the key to conserving heat in workpieces. An example of apparatus according to the present invention designed to accomplish that is shown in the drawings.

The Drawings

In FIG. 1 there is illustrated a conventional billet transporting device in the form of a self-propelled tractor and crane unit 10. The crane portion 12 includes a billet support means in the form of a gripping device 14 which is hydraulically controlled, employing conventional hydraulic lines and controls (not shown) for opening and closing its jaw members 16 in order to permit gripping and releasing a billet 18. As is described further below, the gripping means 14 is movable between a retracted position, as illustrated, and an extended position, as indicated in broken lines, with respect to an enclosure means 18. The enclosure means comprise segments 20 and 22 which are connected to each other through hinge 24 to permit relative movement therebetween, as further described below. The vehicle portion of the device 10 is modified to include a source 28 of inert gas (e.g., argon), a regulator 30 connected to the outlet of the source 28 and operated by control 32, and a feed line 34 connected to a coupling 36 communicating with the interior of the enclosure means segment 22. In the situation illustrated in FIG. 1, the billet 18 is disposed within a furnace 38 having a door 40 which has been opened to permit access to the billet.

Details of the support means 14 and the enclosure means 18 are described with reference to the more detailed illustrations of FIGS. 2–5.

In the embodiment illustrated in FIGS. 2–5, a terminal portion 42 of the crane device supports the enclosure means 18 and projects therethrough. The projecting portion forms a telescopic, hydraulically-driven extension means 44 at the end of which is disposed the support or gripping means 14. The telescopic means 44 may be actuated by conventional hydraulic lines (not shown) disposed within the member 42. Double-acting hydraulic cylinder and piston mechanisms 46 are pivotally connected at opposite ends to the terminal portion 48 of the telescopic means 44 and to one of the jaw members 16. Conventional hydraulic lines (not shown, but which may also be provided internally of member 42 and telescopic means 44) are connected to the cylinders 46 for actuation of the gripping means 14.

Figure 3:
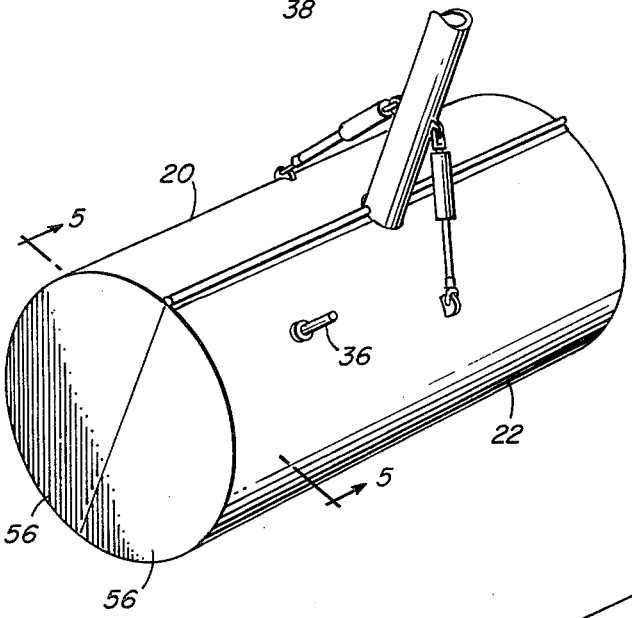
FIGS. 2 and 3 are perspective views of a major operative portion of apparatus constructed in accordance with the present invention showing that apparatus in, respectively, open and closed configurations.
Figure 2:
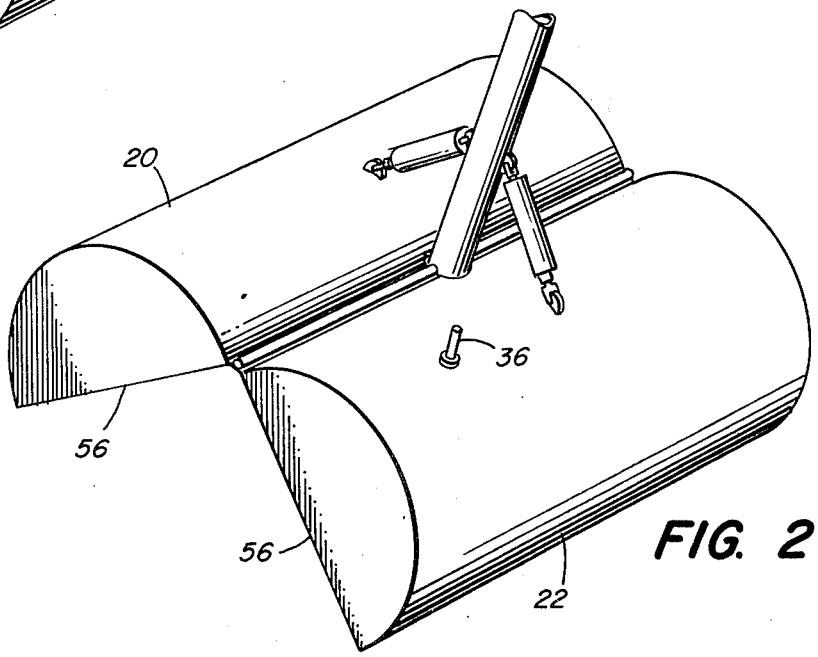
Figure 5:
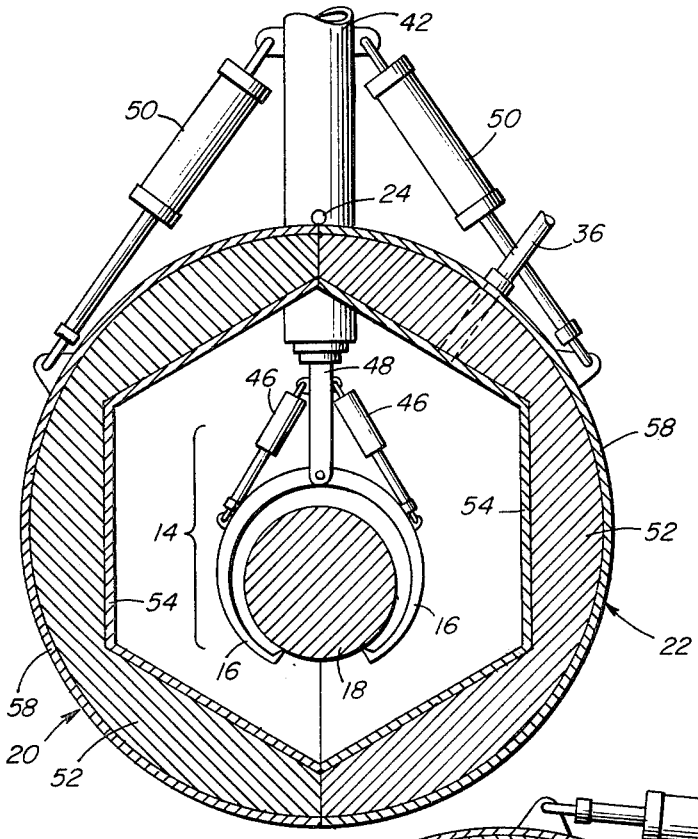
FIGS. 4 and 5 are transverse sectional views of the apparatus of FIGS. 2 and 3 again illustrating the apparatus in, respectively, open and closed configurations.
Figure 4:
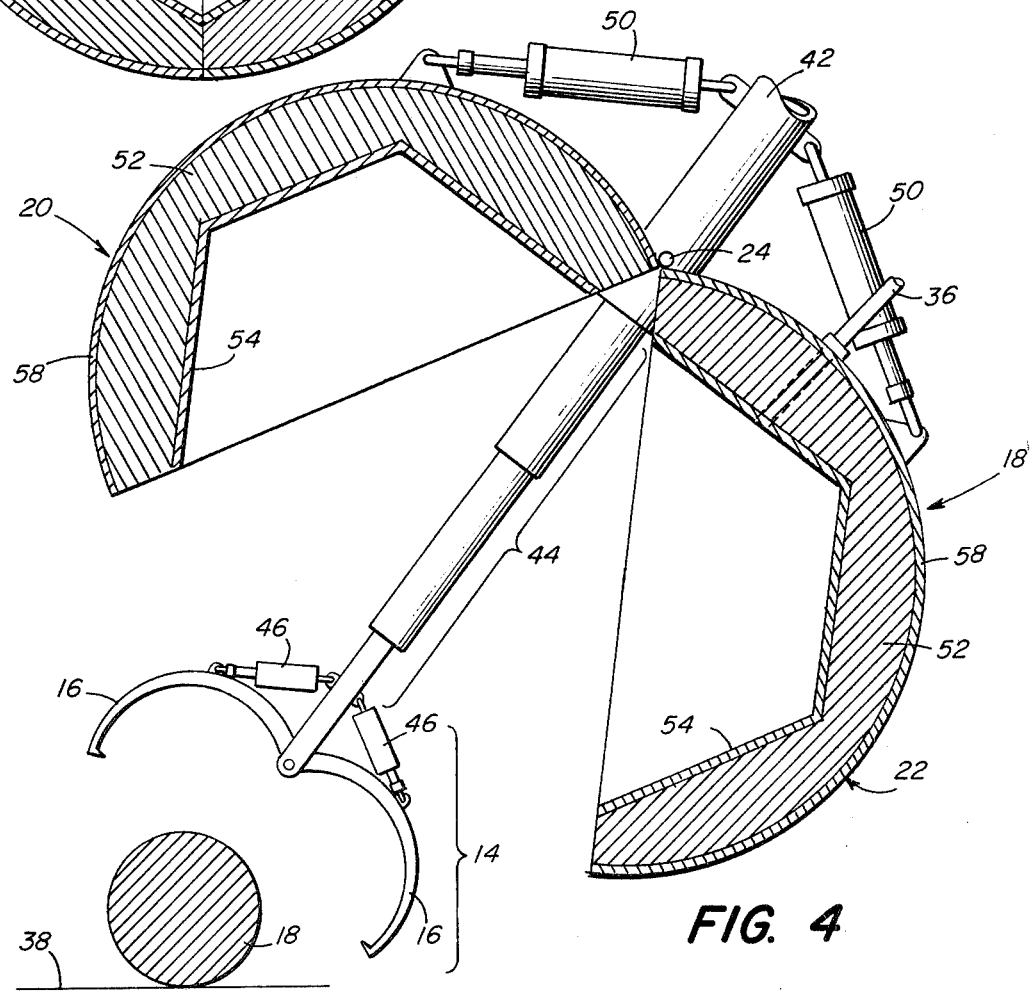

The segments 20 and 22 are driven between the open configuration of FIGS. 2 and 4 and the closed configuration of FIGS. 3 and 5 by a second set of double-acting hydraulic cylinder and piston sets 50 pivotally connected at opposite ends to the member 42 and the exterior of the segments 20 and 22. Again, for simplicity, the hydraulic lines are not illustrated.

Each of the segments 20, 22 comprises a rigid body 52 having an interior surface that is coated with a material 54 that is highly reflective of infrared radiation. In the illustrated embodiment, each segment has an inner surface that defines three symmetrically arranged faces disposed parallel to the axis of a billet 18 gripped by the jaw members 16 (see FIG. 5). Each of the end plates 56 of each segment has its interior surface similarly coated with the infrared reflective material 54. In the illustrated embodiment, therefore, the enclosure means define an interior surface that is highly reflective of infrared radiation and that forms a right angle prismatic figure surrounding the workpiece 18 and support means 14. Naturally, numerous other geometrical configurations of the interior surface are possible, it being important to substantially enclose the high temperature workpiece 18 with a surface substantially reflective of infrared radiant energy.

Where it is anticipated that the enclosure means 18 may have to be placed near, or even in, the furnace (as is the case in FIG. 1), it is preferred to provide a similar infrared reflecting coating 58 over the exterior of each enclosure means segment 20, 22. This provision will, in large measure, prevent absorption of heat by the enclosure means body portion 52.

The reflective coatings 54 and 58 are preferably multiple-layer arrangements incorporating thin layers of the actual reflective material and of an overlying protective material. For example, the actual reflecting layer may comprise gold, copper, aluminum, or multiple metallic layered materials applied directly to the body 52 by any conventional technique. The thickness of such layers would range from submicron to micron dimension. Since such reflective layers would typically be both delicate and expensive, it is preferred to overlie such layers with protective films which are substantially transparent to the radiation to be reflected. Examples of suitable films are the oxide films of $TiO_2$, $ZrO_2$, MgO, $Al_2O_3$. Such films would be provided in a thickness sufficient to give mechanical protection to the underlying coating but thin enough to avoid undesirable interference effects and absorbtion of infrared radiation. A typical thickness would be approximately 1,000 Angstroms.

It is preferred that the interior reflecting surface 54 exhibit high specular reflectivity since, in various circumstances, such surfaces will exhibit a higher level of reflectivity than non-specular surfaces. These will also return radiation to the billet with fewer reflections than is the case with surfaces exhibiting diffuse reflectivity, in many cases.

In the operation of the illustrated embodiment, the vehicle portion 26 of the apparatus 10 is driven to a position adjacent the furnace 38. With the furnace door 40 in an open configuration (or through the opening of a doorless furnace) the terminal portion 42 of the crane arrangement 12 is inserted and then the gripping means 14 extended by actuation of the telescopic device 44. Once the jaw members 16 are in position around the workpiece 18, actuation of the hydraulic cylinders 46 causes the jaw members to grip the workpiece. Subsequent retraction of the telescopic means 44 withdraws the workpiece into the enclosure means 18. Actuation of the hydraulic cylinders 50 can then be employed to drive the segments 20 and 22 to the closed configuration of FIGS. 3 and 5, thereby substantially surrounding the workpiece 18 and support means 14 with the infrared reflecting surface 54. Since, as is explained above, the dominant mode of heat loss from the workpiece 18 is via radiation, the reflection of radiant heat from the surface 54 back to the workpiece 18 will in large measure prevent the heat loss from the workpiece which has heretofore been the norm.

In many industrial furnaces 38 an inert atomosphere is established and maintained (e.g., through combustion control). After the enclosure means segments 20 and 22 have been driven to the closed configuration of FIG. 5, the control 32 on the vehicle 26 can be employed to admit an inert gas from the source 28 through regulator 30, line 34 and fitting 36 into the interior of the enclosure means 18. With the illustrated arrangement, therefore, the workpiece can be transported (or merely maintained) at substantially the same temperature and inert atmosphere that it experienced within the furnace 38, thereby avoiding the detrimental effects described above.

Analytical considerations further support the conclusion that arangements such as described are effective to eliminate the bulk of the heat loss from a workpiece. Thus, if a body of emissivity $\epsilon_1$, at absolute temperature $T_1$, radiates to another surface of emissivity $\epsilon_2$, at temperature $T_2$, and if the second surface totally encloses the first, the net rate of radiant heat transfer ($Q_R$) between the two is given by (*Heat Transmission*, McAdams, McGraw Hill, 1954, p. 63):

$$Q_R = \frac{\sigma(T_1^4 - T_2^4)}{(1/\epsilon_1 + 1/\epsilon_2 - 1)}$$

Now, suppose the second surface is a reflective enclosure, having a reflectivity, ($r_1$) of (say) 0.97. Also, suppose that the temperature of the second surface is so low (e.g., 100° F., 560° R.) that its fourth power can be neglected compared with that of the temperature of the hot metal blank. Since the sum of the reflectivity and emissivity is unity ($r+\epsilon=1$), then the radiative heat loss from the blank to the walls of the enclosure will be only three percent of the "black body" radiative heat loss from the hot forging blank. That is, since $\sigma T_1^4$ is the rate of radiation from a black body surface ($\epsilon_1=1$) at the temperature ($T_1$) of the hot forging blank, and with $\epsilon_1=0.9$, and $\epsilon_2=0.03$.

$$Q_R = \sigma T_1^4 \frac{1}{1/0.9 + 1/0.03 - 1}$$

$$= (0.030)\sigma T_1^4$$

Thus, the reflective barrier of the enclosure is very effective in reducing the rate of radiative heat loss from the blank. To gain a full appreciation of how effective the reflective barrier is in preventing radiant heat losses, one may consider the temperature ($T_2$) to which the walls of an enclosure would have to rise in order to return 97 percent of the heat flux to the stock by reradiation. If the emissivity of the enclosure were unity (e.g., if the enclosure were made of silica brick, or some similar refractory material) it would have to reach a temperature of (approximately) 2328° F. to provide the insulating properties of the reflective enclosure considered here.

In addition, one notes that in the case considered here 3 percent of the heat flux from the stock will be absorbed, and dissipated, on the surface of the enclosure. This amounts to a heat flux of 2879 Btu/hr·ft$^2$ (stock) that must be dissipated on the surface of the enclosure. It the surface area of the enclosure were ten times as great as the surface area of the stock, then for natural convection on the outside of the enclosure to provide this amount of dissipation, the surface temperature of the enclosure would have to rise by about 288° F. above ambient. If the surface areas of the stock and the enclosure were equal, one could provide forced convection outside the enclosure (for which case the film coefficient is approximately 10) to keep the increase in temperature of the enclosure to approximately the same level (288° F.). Of course, if the surface area of the enclosure were ten times as great as that of the stock, and if forced convection were used, the enclosure could be kept very cool, say about 23° F. higher than ambient temperature. This would be cool enough to touch safely.

While particular preferred embodiments of the present invention have been illustrated in the accompanying drawings and described in detail herein, other embodiments are within the scope of the invention and the following claims.

I claim:

1. In an apparatus for transporting a workpiece that is at a temperature substantially above the ambient, the apparatus including support means for supporting the workpiece, the improvement wherein said apparatus includes enclosure means including an interior surface coating positioned to be exposed to but separated from a workpiece supported in said support means and formed from a material that is highly reflective of radiant infrared energy, said enclosure means comprising at least two segments, at least one of which is movable relative to the other between a first open configuration facilitating entry of a workpiece therebetween and a second closed configuration in which said interior surface of said enclosure means substantially surrounds said support means and said workpiece.

2. In the apparatus of claim 1, the further improvement wherein said one segment of said enclosure means is hingedly secured to the other segment of said enclosure means, and wherein the apparatus further includes drive means for driving said segments between said open and closed configurations.

3. In the apparatus of claim 1, the further improvement wherein there is provided a source of inert gas and means for delivering inert gas from said source to the interior of said enclosure means.

4. In the apparatus of claim 1, the further improvement wherein the exterior surfaces of said enclosure means are reflective of infrared radiant energy.

5. In the apparatus of claim 1, the further improvement wherein said support means comprise gripping means including jaw members for gripping a workpiece, said gripping means being supported for movement relative to said enclosure means, whereby said gripping means can be driven to a position exterior of said enclosure means to grip a workpiece, and can be retracted to the interior of said closure means.

6. In the apparatus of claim 1, the further improvement wherein said support means define a longitudinal axis along which said workpiece is supported and wherein said interior surface of said enclosure means has a shape that is substantially symmetrical with respect to said axis.

7. In the apparatus of claim 1, the further improvement wherein said interior surface coating reflects radiant infrared energy specularly.

8. In apparatus for transporting a workpiece that is at a temperature substantially above the ambient, the apparatus including support means for supporting the workpiece, the improvement wherein the support means comprise gripping means adapted for releasably gripping the workpiece, enclosure means comprising at least two segments cooperating in a closed position thereof to form an enclosure for the gripping means and workpiece, and means for moving said segments relative to one another between said closed position and an open position facilitating entry of the workpiece into the gripping means, said segments having interior surfaces highly reflective of infrared radiant energy located in said closed position to face and surround the workpiece in spaced relation thereto.

* * * * *